US009165441B2

(12) United States Patent
Tinti

(10) Patent No.: US 9,165,441 B2
(45) Date of Patent: Oct. 20, 2015

(54) ANTI-THEFT DEVICE FOR OBJECTS ON DISPLAY

(75) Inventor: Fabrizio Tinti, Gessate (IT)

(73) Assignee: Total Protection Service S.R.L., Gessate (IT)

( * ) Notice: Subject to any disclaimer, the term of this patent is extended or adjusted under 35 U.S.C. 154(b) by 81 days.

(21) Appl. No.: 14/236,602

(22) PCT Filed: Jul. 19, 2012

(86) PCT No.: PCT/EP2012/064221

§ 371 (c)(1), (2), (4) Date: Jan. 31, 2014

(87) PCT Pub. No.: WO2013/017427

PCT Pub. Date: Feb. 7, 2013

(65) Prior Publication Data

US 2014/0152441 A1 Jun. 5, 2014

(30) Foreign Application Priority Data

Aug. 1, 2011 (IT) ..... MI2011A1465

(51) Int. Cl.
*G08B 13/12* (2006.01)
*G08B 13/14* (2006.01)
*G08B 29/04* (2006.01)

(52) U.S. Cl.
CPC ..... *G08B 13/14* (2013.01); *G08B 13/149* (2013.01); *G08B 13/1463* (2013.01); *G08B 29/046* (2013.01)

(58) Field of Classification Search
CPC ..... G08B 13/14; G08B 13/1463
USPC ..... 340/568.1, 568.2, 568.4, 571, 572.1
See application file for complete search history.

(56) References Cited

U.S. PATENT DOCUMENTS

| | | | | |
|---|---|---|---|---|
| 4,455,464 | A | 6/1984 | Leyden | |
| 4,616,113 | A | 10/1986 | Jank et al. | |
| 7,239,238 | B2 * | 7/2007 | Tester et al. | 340/539.31 |
| 2006/0170550 | A1 * | 8/2006 | Marsilio et al. | 340/568.2 |
| 2010/0231388 | A1 * | 9/2010 | Shute et al. | 340/568.4 |

FOREIGN PATENT DOCUMENTS

| | | |
|---|---|---|
| NL | 1018534 C2 | 8/2002 |
| WO | 0245042 A1 | 6/2002 |

OTHER PUBLICATIONS

International Search Report and Written Opinion, PCT/EP2012/064221 dated Apr. 9, 2012, pp. 1-11.
Italian Search Report, Italian Application No. MI2011A001465 dated Mar. 26, 2012, pp. 1-2.

* cited by examiner

*Primary Examiner* — Kerri McNally
(74) *Attorney, Agent, or Firm* — Brooks Kushman P.C.

(57) ABSTRACT

An anti-theft device for objects on display is provided. The anti-theft device includes a containment body which accommodates internally at least one electric circuit provided with elements for closing the electric circuit. At least one cable is also provided, which has a first end accommodated in a corresponding seat defined in the containment body and a second end which can be inserted in an opening defined by the containment body in order to form a loop which can be associated with an object to be alarmed in such a manner that the object to be alarmed is in contact with the containment body. The anti-theft device includes elements for preventing the intrusion of foreign objects in the containment body in order to prevent the jamming of the cable in the containment body.

9 Claims, 5 Drawing Sheets

ANTI-THEFT DEVICE FOR OBJECTS ON DISPLAY

CROSS-REFERENCE TO RELATED APPLICATION

This application is the U.S. national phase of PCT Application No. PCT/EP2012/064221 filed on Jul. 19, 2012, which claims priority to Italian Patent Application No. MI2011A001465 filed on Aug. 1, 2011, the disclosures of which are incorporated in their entirety by reference herein.

The present invention relates to an anti-theft device for objects on display.

Several different anti-theft or anti-shoplifting devices are known for objects on display on shelves in shops or in stands at trade fairs or the like.

Conventional devices comprise a body within which an electric alarm circuit is accommodated, which is provided for example with sensors (microswitches) and which is connected by way of a connection cable to a remote control unit.

Conventional devices are attached to the objects by way of bi-adhesive strips and/or plastic straps or the like which can be easily removed and tampered with in order to release the object or part thereof without making the alarm go off.

Think for example of a cellular telephone which is fixed by way of a bi-adhesive strip to such an anti-theft device. The cover of the telephone can be easily opened once the strip has been cut or loosened, and then separated from the telephone. In this manner the cover remains attached to the device keeping the microswitch closed, and no alarm will be triggered.

These conventional devices, while they have been shown to be quite effective, are, thus, susceptible of further improvements in particular with regard to the possibility of alerting to any attempt at tampering and theft of an object on display and of ensuring a stable and secure attachment of such devices to the objects.

In order to overcome the above mentioned drawbacks, anti-theft devices have been devised which consist substantially of a small box which contains, inside it, an electric circuit that is normally open and which can be closed by way of a cord which exits from the box in such a manner as to form a loop which can be fixed to the object to be alarmed.

More precisely, the cord has a first end which is fixed to the interior of the box and a second end which can be inserted into the box through an adapted opening and can be engaged with retention means which are adapted to retain such second end, so as to prevent a possible extraction thereof from the opening.

The cord thus defined is such as to define the electric circuit contained in the box in such a way that any breakage of the cord can be detected by the electric circuit which automatically triggers the alarm.

In addition, such conventional anti-theft devices comprise means which are adapted to detect a variation in voltage of the cord so as to also detect attempts to tamper with the device.

Such conventional devices are not devoid of drawbacks, including the fact that by introducing a small, slender body into the opening of the box, such as for example a pin, it is possible to jam the cord, making it possible for the shoplifter to manipulate the anti-theft device in order to disassociate it from the object on which it is applied without cutting it.

In fact, such practice could make it possible to bypass the means designed to detect the variation in voltage of the cord.

The aim of the present invention is to provide an anti-theft device for objects on display which can be securely and stably attached to any object on display and which makes it possible to alert to any attempt at tampering with or removal of the object or part of the object to which it is applied.

Within this aim, an object of the present invention is to provide a device with a simple structure, which is easy and practical to implement, safe in use and effective in operation, and low cost.

This aim and this object and others which will become better apparent hereinafter are all achieved by an anti-theft device for objects on display, comprising a containment body which accommodates internally at least one electric circuit provided with means for closing said electric circuit, at least one cable being also provided which has a first end accommodated in a corresponding seat defined in said containment body and a second end which can be inserted in an opening defined by said containment body in order to form a loop which can be associated with an object to be alarmed in such a manner that said object to be alarmed is in contact with said containment body, characterized in that it comprises means for preventing the intrusion of foreign objects in said containment body in order to prevent the jamming of said cable in said containment body.

Further characteristics and advantages of the present invention will become better apparent from the detailed description of some preferred, but not exclusive, embodiments of an anti-theft device for objects on display according to the invention, which is illustrated, by way of non-limiting example, in the accompanying drawings, wherein.

Figure 1:
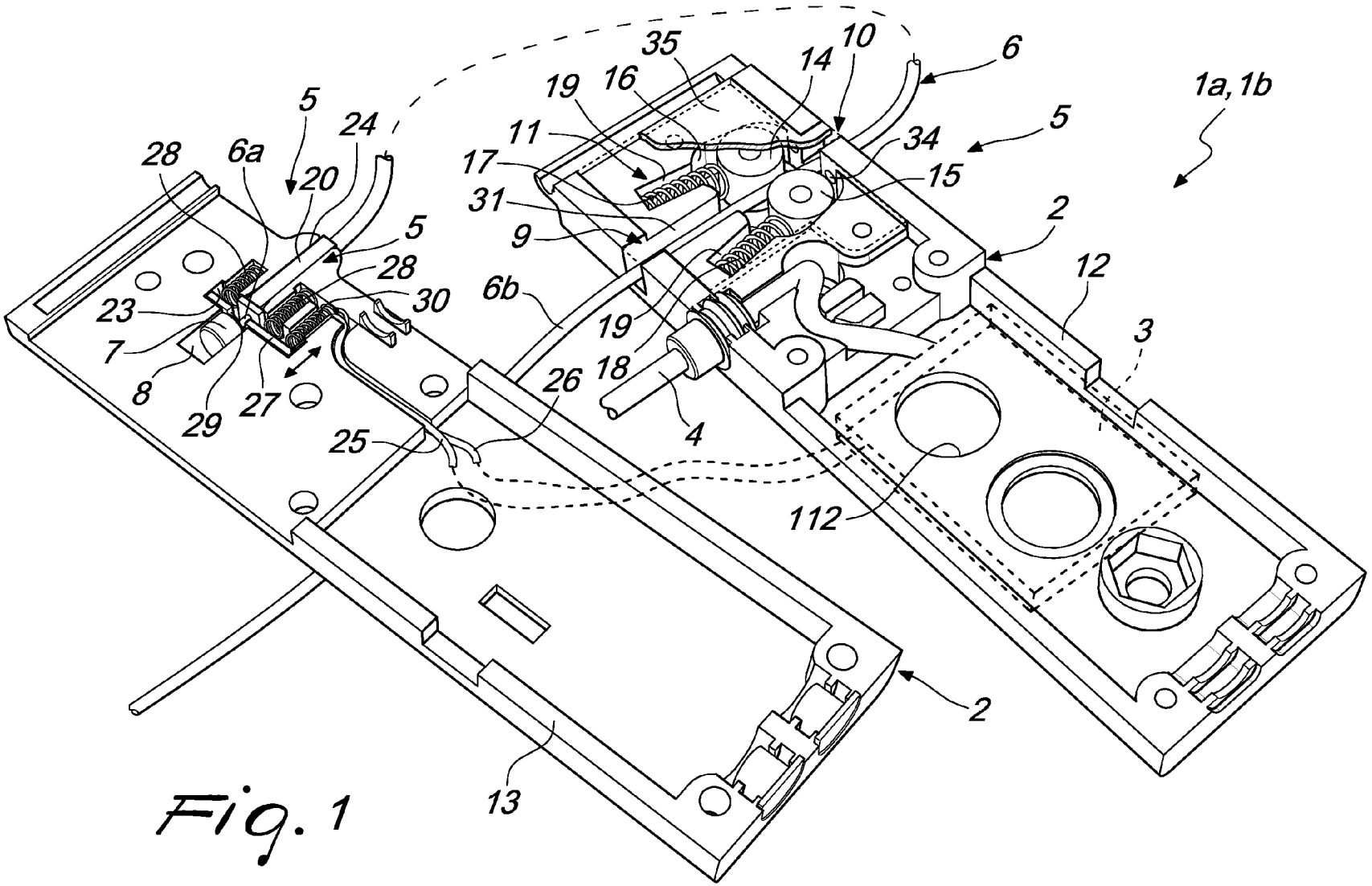
FIG. 1 is a partially exploded perspective view of an anti-theft device for objects on display, according to the invention.

With reference to the figures, the reference numerals 1*a* and 1*b* generally designate an anti-theft or anti-shoplifting device for objects on display.

The anti-theft device 1*a* or 1*b* comprises a containment body 2 within which at least one electric alarm circuit 3 is accommodated, which can be connected, by way of a connection cable 4, to a remote control and actuation unit, i.e. to an alarm control unit, which is not shown.

The anti-theft device 1*a* or 1*b* moreover comprises means 5 of closing the electric circuit 3 which are at least partially accommodated inside the containment body 2 and at least one cable 6 which forms part of or which actuates the closure means 5.

Figure 4:
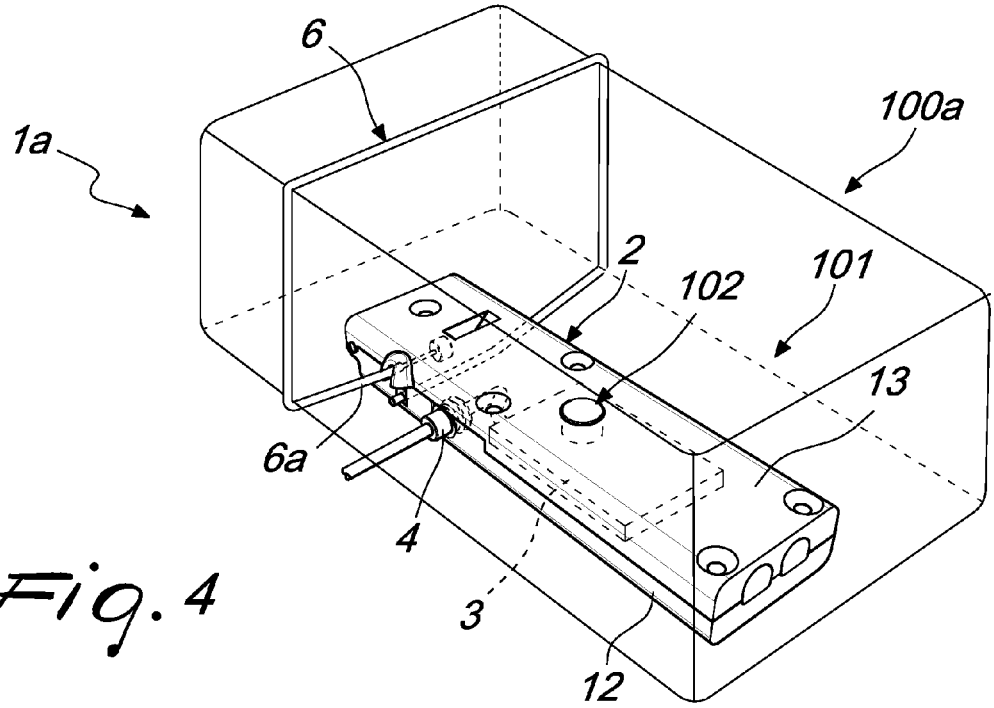
FIG. 4 is a perspective view of the anti-theft device shown in FIG. 3 applied to an object to be alarmed.
Figure 6:
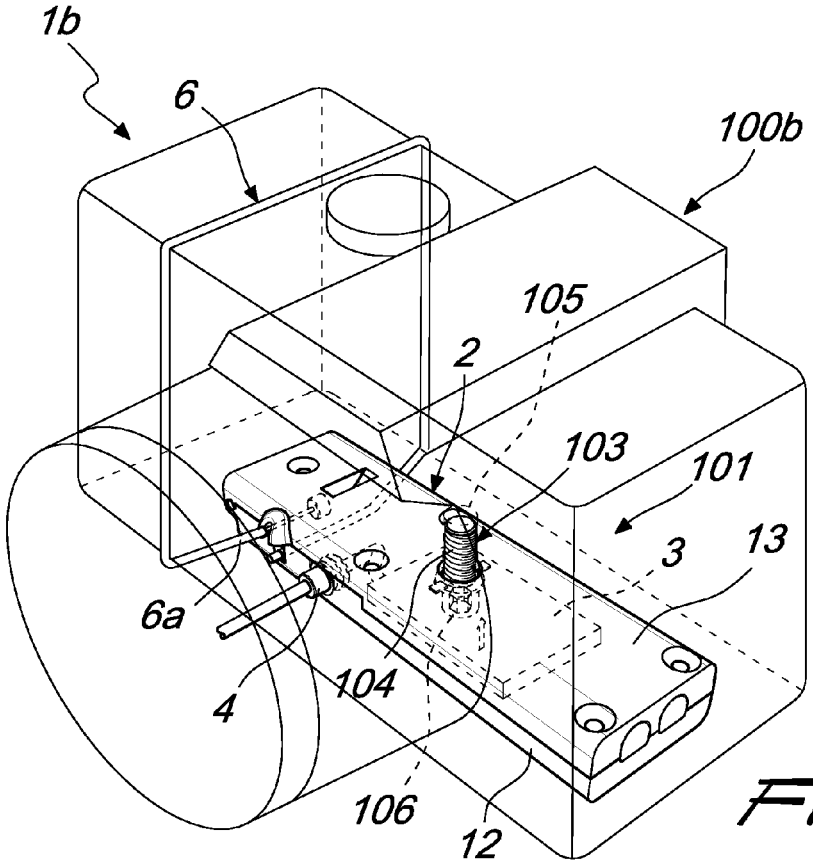
FIG. 6 is a perspective view of the anti-theft device shown in FIG. 5 applied to an object to be alarmed.

The cable 6 has a first end 6*a* which is advantageously provided with a cylindrical tip 7, for example made of a die-cast material, which is accommodated in a corresponding seat 8 which is defined in the containment body 2 and a second end 6*b* which can be inserted in an opening 10 which is defined in the containment body 2 after the cable 6 has been inserted through a slot defined in an object to be alarmed 100*a* or 100*b* or has been looped around such object, as shown in FIGS. 4 and 6.

Accommodated inside the containment body 2 are cable clamping means 11 which are arranged proximate to and downstream of the opening 10 and which are adapted to allow the sliding of the second end 6*b* of the cable 6 in the direction of insertion into the containment body 2 and to prevent the sliding of the second end 6*b* of the cable 6 in the direction of egress from the containment body 2.

The containment body 2 is constituted by a box 12 which is closed by a cover 13 which is removably associated therewith by way of connection elements for example of the threaded type.

The cable clamping means 11 comprise a pair of wheels 14 and 15 which rest movably on the bottom of a hollow 16 which is provided in the box 12 and which is connected to the opening 10.

Figure 2:
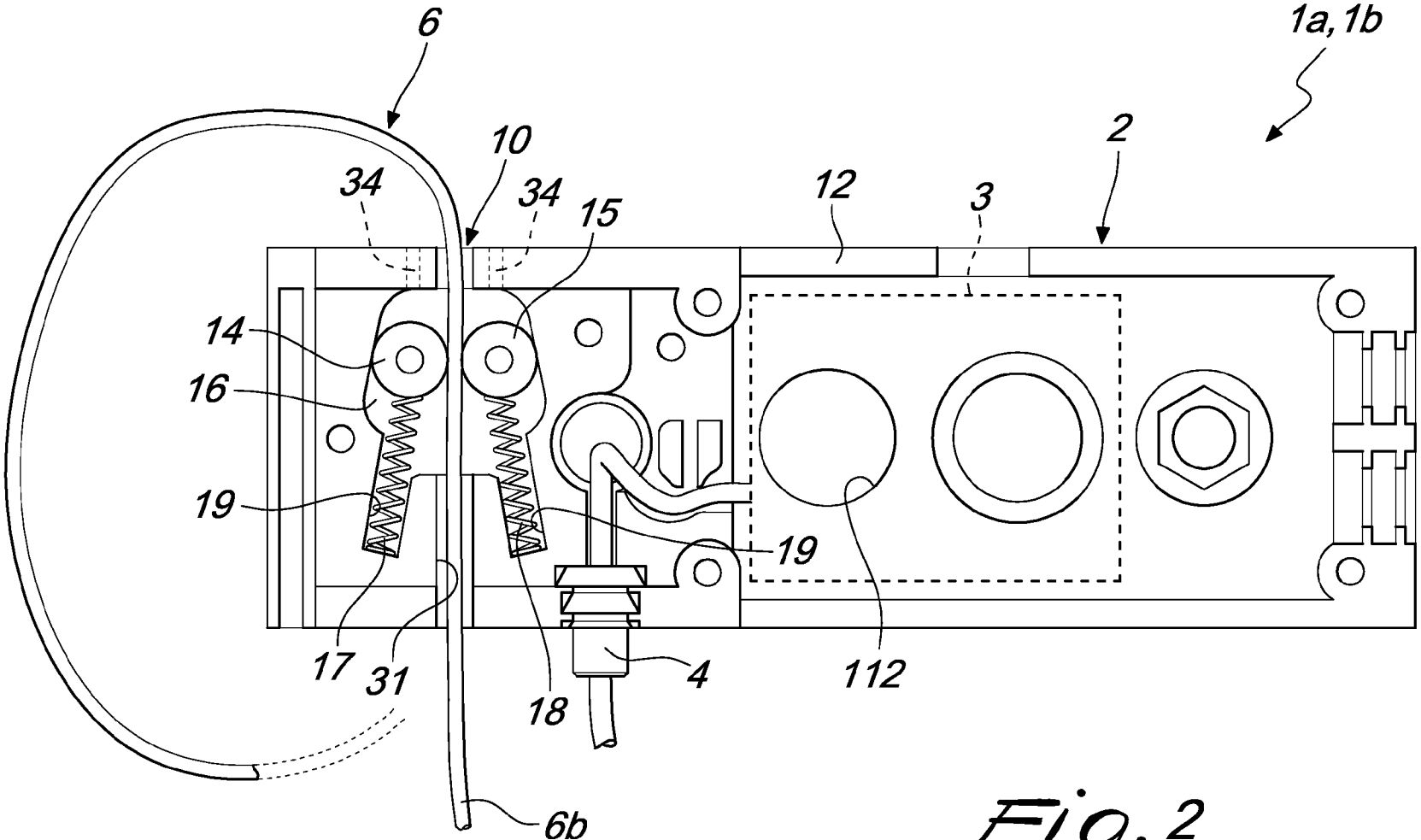
FIG. 2 is a plan view from above of part of the anti-theft device shown in FIG. 1.

The hollow 16, in plan view as shown in FIG. 2, has a shape that diverges from the opening 10 toward the interior of the containment body 2.

More precisely, in the embodiments proposed, the hollow 16 has a substantially isosceles trapezium shape with the opposing bases arranged at right angles to the direction of insertion of the second end 6*b* of the cable 6 and with the shorter base of the trapezium being proximate to the opening 10.

Such shape is not intended to be limiting, and the hollow 16 can have different shapes.

The two wheels 14 and 15 are kept arranged mutually side by side at the convergent portion of the hollow 16, i.e. at the shorter base of the trapezium, by elastic pusher means which are constituted by a corresponding spring 17 and 18.

Each one of the two springs 17 and 18 is partially inserted in a corresponding guide mortise 19 which extends from the hollow 16 in the opposite direction with respect to the opening 10.

The two mortises 19 are also mutually convergent toward the two wheels 14 and 15 and divergent in the opposite direction, i.e. toward the interior of the containment body 2.

In this manner, the second end 6*b* of the cable 6 is insertable between the two wheels 14 and 15 in contrast with the action exerted on them by the springs 17 and 18.

In fact, due to the shape of the hollow 16 and the mobility of the wheels 14 and 15, upon which the springs 17 and 18 act, by exerting a pushing action on the cable 6 it is possible to insert its second end 6*b* between the two wheels 14 and 15. When such pushing action is stopped, the cable 6 thus inserted remains gripped between the two wheels 14 and 15 which prevent the sliding thereof in the direction of egress from the containment body 2 even if a traction action is exerted on the cable 6 from the outside. On the contrary, if the cable 6 is pulled in the direction of egress, the wheels 14 and 15 advance toward the narrower part of the hollow 16 thus making the clamping of the cable 6 clenched between the wheels 14 and 15 even more effective.

Advantageously, resting on the bottom of the hollow 16 is a plate made of plastic material which is adapted to improve the sliding of the mobile elements contained inside the containment body 2.

Moreover, alternative embodiments of the cable clamping means which are technically equivalent are not ruled out.

The seat 8 for accommodating the first end 6*a* of the cable 6, which is introduced until the abutment of the cylindrical tip 7 made of a die-cast material, is open to the outside of the containment body 2 and is accessible from the outside for the insertion and substitution of the cable 6.

The seat 8 is connected to a chamber 23 for accommodating closure means 5 which is defined in the containment body 2 and is provided, on a side opposite to that connected with the seat 8, with a channel or a hole 24 for the passage of the cable 6.

The cable 6, or rather the second free end 6*b* thereof, is inserted from the outside through the seat 8 and, after passing through the chamber 23, exits from the hole 24 in order to be inserted, after being looped around an object, into the opening 10 where it is clenched against being extracted by the cable clamping means 11.

As will be made clear hereinbelow, the first end 6*a* of the cable 6 interacts with and actuates the closure means 5 of the electric circuit 3 and for this reason it must not be jammed.

The seat 8, the chamber 23 and the hole 24 are provided in the cover 13.

The closure means 5 of the electric circuit 3 comprise moreover a first contact 25, a second contact 26 and a trigger or plate 27, for closing the first contact 25 and the second contact 26, which is accommodated so that it can move within the chamber 23 proximate to the seat 8.

The plate 27 is kept in the open configuration of the first contact 25 and of the second contact 26 by first elastic pusher elements which are constituted by one or more first springs 28.

The first end 6*a* of the cable 6 acts on the plate 27 or metallic plate and, when it is looped and tightened around an object, moves the plate 27 from an open configuration to a configuration in which the first contact 25 and the second contact 26 are closed in contrast with the action exerted by the first springs 28 thus acting as a bridge between the contacts.

In such case any action that tends to loosen the cable 6 or reduce its voltage, such as for example the extraction of the object surrounded by it, is such as to open the closure means 5 and, therefore, trigger the alarm.

In more detail, the plate 27 is interposed between the seat 8 and the hole 24 and is arranged in a direction which is transverse to the direction of insertion of the cable 6.

The plate 27 has a notch 29 for the passage of the cable 6 except for the first end 6*a*. The first end 6*a* in fact is constituted by an enlarged head the base of which defines an abutment surface which is adapted to be arrested on the plate 27.

The plate 27 is pushed into the open configuration by a pair of first springs 28, to one of which one of the two contacts is connected, for example the first contact 25. The other of the two contacts, the second contact 26, is instead connected to second elastic elements which are constituted by a second spring 30 which is accommodated in the chamber 23 and is of shorter length than the first springs 28.

The first springs 28, the second spring 30 and the plate 27 are electrical conductors.

In the open configuration the plate 27 is in contact with the first springs 28 but not with the second spring 30.

The first end 6*a* of the cable 6 is adapted to push the plate 27 in contrast with the action of the first springs 28 thus leading it to make contact with the second spring 30 as well and, therefore, the second contact 26, thus closing the electric circuit 3.

In the containment body 2, in particular in the box 12, a channel 31 for the egress of the second end 6*b* of the cable 6 is provided downstream, in the direction of insertion of the second end 6*b*, of the cable clamping means 11 and substantially aligned with the opening 10.

The second end 6*b* of the cable 6 thus passes through the containment body 2 and is held by the cable clamping means 11 which prevent the sliding thereof in the direction of egress.

The presence of the channel 31 makes it possible to tension the cable 6 around the object.

According to the invention, in order to prevent the unwanted insertion of foreign objects in the containment body 2, which are adapted to jam the cable 6 in the hole 24 so as to prevent the anti-theft device 1*a* or 1*b* from detecting variations of voltage in the cable 6, advantageously intrusion prevention means 9 are provided.

More precisely, such intrusion prevention means 9 comprise a tubular body 20 which is arranged in the hole 24 downstream of the plate 27.

In this manner, the second end 6*b* of the cable 6 and no other foreign body can be inserted in the tubular body 20.

The contact of the end of the tubular body 20 with the plate 27 ensures that any attempt at sabotage will push the plate 27, separating it from the contacts 25 and 26.

In the containment body 2, proximate to the opening 10, at least one access hole 34 is provided for a tool for unjamming the cable clamping means 11. Such tool can be constituted for example by one or two pointed tips which, once inserted in the access hole 34, act on one or two of the wheels 14 and 15 by pushing them, in contrast with the action of the corresponding spring 17 or 18, toward the divergent portion of the hollow 16 so as to free the second end 6*b* of the cable 6 which can then be extracted.

Moreover, an isolation plate 35 is provided which is interposed between the box 12 and the cover 13.

Moreover, sensor means 101 of the electric circuit 3 are provided, which can be actuated by the object to be alarmed 100*a* or 100*b* when it is associated with the containment body 2 in order to close the electric circuit 3.

Figure 3:
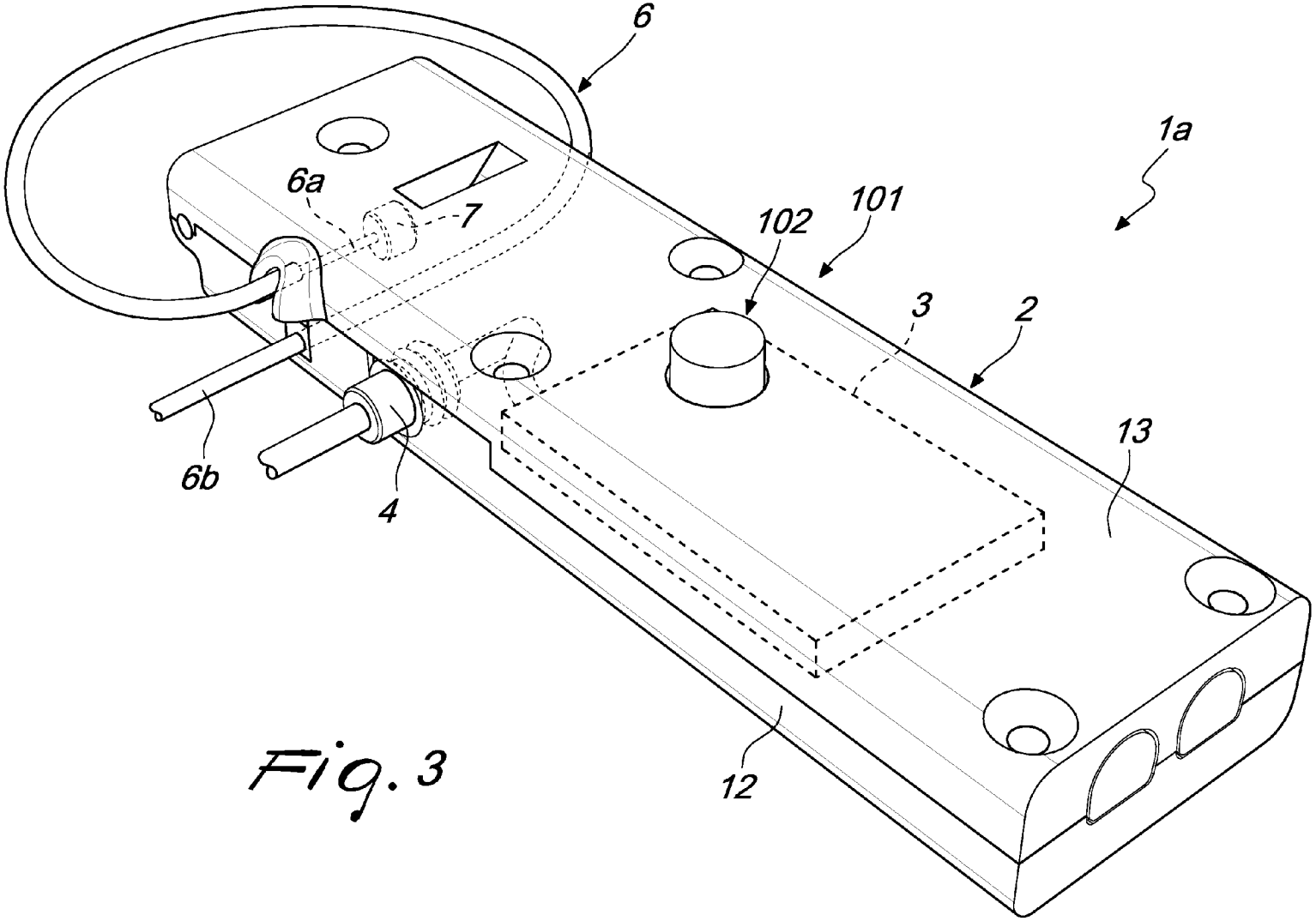
FIG. 3 is a perspective view of a first embodiment of the anti-theft device according to the invention.

More precisely, with reference to FIGS. 3 and 4, in a first embodiment of the anti-theft device 1*a*, the sensor means 101 comprise a microswitch 102 which protrudes from the containment body 2 and is associated with the electric circuit 3 and can engage the object to be alarmed 100*a* by pressing against it in order to close the electric circuit 3.

Figure 5:
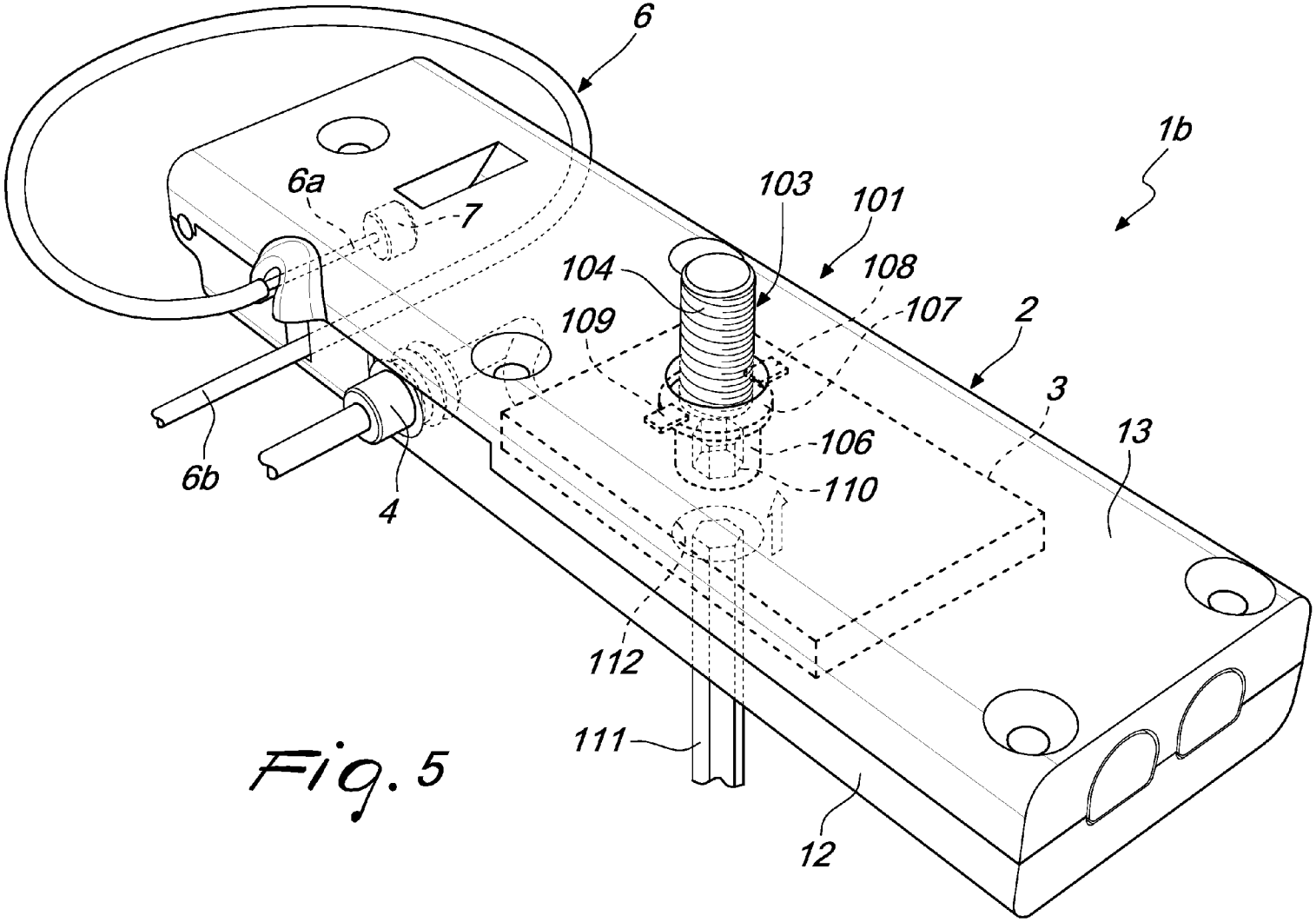
FIG. 5 is a perspective view of a second embodiment of the anti-theft device according to the invention.

With reference to FIGS. 5 and 6, in a second embodiment of the anti-theft device 1*b*, the sensor means 101 comprise a screw body 103 which protrudes from the containment body 2 with a threaded shank 104 thereof which can be engaged in a threaded hole 105 which is provided on the object to be alarmed 100*b*.

For example, if the object to be alarmed 100*b* is a still camera or a videocamera, the threaded hole 105 can be provided by the seat normally intended for fixing a tripod to the photographic apparatus.

More specifically, the screw body 103 comprises an end head 106 which defines screwing and unscrewing means and comprises a central portion 107 which is radially wider and intended to act as an electric bridge between two points 108 and 109 of the electric circuit 3 following the engagement of the threaded shank 104 in the threaded hole 105.

For example, the screwing and unscrewing means can comprise a hexagonal hollow 110, which can be engaged by part of a corresponding Allen key 111, passing through a through hole 112 which is provided in the containment body 2, or such means can comprise a contoured hollow which can be engaged by part of a corresponding contoured key.

Operation of the anti-theft device 1*a* and 1*b* according to the invention is the following.

The containment body 2 is tightly attached to the object to be alarmed 100*a* or 100*b* around which the cable 6 is looped.

The application of the anti-theft device 1*a* or 1*b* to the object to be alarmed 100*a* or 100*b* occurs by making the second end 6*b* of the cable 6 pass through the seat 8, which is open outward, and then, after passing through the chamber 23, through the hole 24. The first end 6*a* of the cable 6 rests against the plate 27 due to the presence of the cylindrical tip 7, while the rest of the length of the cable 6 is looped around the object to be alarmed 100*a* or 100*b* which rests on the containment body 2.

At this point, the second end 6*b* of the cable 6 is inserted into the opening 10 and, after passing through the cable clamping means 11, exits through the channel 31. The cable 6 is then looped and tightened around the object to be alarmed 100*a* or 100*b* which rests on the containment body 2.

In this manner the first end 6*a* of the cable 6 moves the plate 27 into the closed configuration of the first contact 25 and of the second contact 26.

Any action that tends to loosen the cable 6, such as for example the extraction of the object which is attached to the containment body 2, causes, due to the reaction of the first springs 29, the movement of the plate 27 to the open configuration of the electric circuit 3 and, thus, triggers the alarm signal.

With reference to FIGS. 3 and 4, in the first embodiment of the anti-theft device 1*a*, the pressure exerted between the containment body 2 and the object to be alarmed 100*a* engages the microswitch 102 which closes the electric circuit 3.

As an alternative to the microswitch 102 it is possible to use a movement sensor.

In the event of mutual distancing between the object to be alarmed 100*a* and the containment body 2, the microswitch 102 returns and opens the electric circuit 3, thus triggering the alarm.

Similarly, with reference to FIGS. 5 and 6, in the second embodiment of the anti-theft device 1*b*, the screwing of the screw body 103 into the threaded hole 105 brings the radially wider central portion 107 into contact with the two points 108 and 109 of the electric circuit 3, thus acting as an electric bridge.

In the event of mutual unscrewing of the screw body 103 from the threaded hole 105 of the object to be alarmed 100*b*, the radially wider central portion 107 will be moved away from the two points 108 and 109, which leads to the opening of the electric circuit 3, thus triggering the alarm.

In both embodiments, in order to release the anti-theft device 1*a* or 1*b* from the object to be alarmed 100*a* or 100*b* to which it is applied it is sufficient to insert a tool of the type of a pointed tip into the corresponding access hole 34 in order to unjam the cable clamping means 11 and extract the second end 6*b* of the cable 6.

In practice it has been found that the invention as described achieves the intended aims.

The anti-theft device according to the invention is, in fact, applied to an object in a secure and stable manner. Thanks to the jamming of the cable by way of the cable clamping means and thanks to the interaction of the cable with the means of closing the electric alarm circuit, any action aimed at tampering with the coupling between the cable and the object, such as breakage or loosening of the cable itself, and the removal of the containment body from the object to be alarmed, is such as to trigger the alarm signal.

The anti-theft device for objects on display thus conceived is susceptible of numerous modifications and variations all of which are within the scope of the appended claims.

Moreover, all the details may be substituted by other, technically equivalent elements.

In practice the materials employed, provided they are compatible with the specific use, as well as the contingent dimensions and shapes, may be any according to requirements.

The disclosures in Italian Patent Application No. MI2011A001465 from which this application claims priority are incorporated herein by reference.

The invention claimed is:

1. An anti-theft device for objects on display, the anti-theft device comprising:

a containment body which accommodates internally at least one electric circuit provided with means for closing the electric circuit, at least one cable being also provided which has a first end accommodated in a corresponding seat defined in the containment body and a second end which can be inserted in an opening defined by the containment body in order to form a loop which can be associated with an object to be alarmed in such a manner that the object to be alarmed is in contact with the containment body, further comprising means for preventing the intrusion of foreign objects in the containment body in order to prevent the jamming of the cable in the containment body.

2. The anti-theft device according to claim 1, further comprising cable clamping means which are defined inside the containment body proximate to the opening in order to prevent the sliding of the second end in the direction of extraction from the containment body.

3. The anti-theft device according to claim 2, wherein the cable clamping means comprise a pair of wheels which rest movably on the bottom of a hollow which is defined inside the containment body, is connected to the opening and has, in plan view, a shape that diverges toward the inside of the containment body, elastic pusher means being also provided which are accommodated in the hollow and are associated with the wheels which are arranged mutually side by side toward the converging portion of the hollow, the second end of the cable being insertable between the two wheels in contrast with the action of the elastic pusher means.

4. The anti-theft device according to claim 2, wherein the means for closing the electric circuit comprise a first contact, which is connected to the first end of the cable, and a second contact, which is connected to the cable clamping means and to the cable, both of which can engage by contact a plate which is accommodated in the containment body.

5. The anti-theft device according to claim 4, wherein the intrusion prevention means comprise a tubular body, which is arranged in a hole defined downstream of the plate, the second end of the cable being insertable in the tubular body.

6. The anti-theft device according to claim 1, wherein the electric circuit comprises a connection cable which can be associated with a remote control and actuation unit.

7. The anti-theft device according to claim 1, further comprising sensor means of the electric circuit which can be actuated by means of the object to be alarmed when it is associated with the containment body in order to close the electric circuit.

8. The anti-theft device according to claim 7, wherein the sensor means comprise a microswitch which protrudes with respect to the containment body, is associated with the electric circuit and can engage the object to be alarmed by pressing in order to close or open the electric circuit.

9. The anti-theft device according to claim 7, wherein the sensor means comprise a screw body that protrudes from the containment body with a threaded shank thereof which can engage in a threaded hole defined in the object to be alarmed, the screw body comprising an end head that defines screwing and unscrewing means and comprising a central portion which is radially wider and intended to act as an electric bridge between two points of the electric circuit following the engagement of the threaded shank in the threaded hole.

* * * * *